United States Patent [19]

Sauer

[11] 4,398,577

[45] Aug. 16, 1983

[54] FLOWABLE PRODUCT METERING AND DISPENSING MACHINE

[76] Inventor: Robert L. Sauer, 5826 W. Glenn Dr., Maple Heights, Ohio 44137

[21] Appl. No.: 182,143

[22] Filed: Aug. 28, 1980

[51] Int. Cl.[3] ..... B65B 3/04

[52] U.S. Cl. ..... 141/135; 141/90; 141/302; 222/642

[58] Field of Search ..... 141/37, 39, 46, 54, 141/192, 197, 198, 286, 40, 49, 52, 53, 302, 57, 58, 63, 64, 227, 303, 144–162, 95, 128, 129–143, 163–191, 89, 90, 91, 92, 258, 259, 260, 261, 262; 222/70

[56] References Cited

U.S. PATENT DOCUMENTS 4,201,249 5/1980 Borstelmann ..... 141/302

*Primary Examiner*—Houston S. Bell, Jr.

*Attorney, Agent, or Firm*—Pearne, Gordon, Sessions, McCoy, Granger & Tilberry

[57] ABSTRACT

A machine is provided which accurately measures and dispenses predetermined quantities of flowable products through an orbiting dispenser into conveyorized containers moving therebeneath. Orbital movement of the dispenser is synchronized with the linear speed of the conveyor so as to begin dispensing a product into a container as the dispenser approaches the lower portion of its cycle. The dispenser is programmed to delay closing for a period of time sufficient to permit substantially all of the product to flow therefrom and to be received into the container. Thereafter, pistons are provided to sweep out product residue from the interior of the dispenser and then to remove by a pulse of air any product residue still clinging to the bottom of the dispenser.

54 Claims, 15 Drawing Figures

300
PILOT AIR SUPPLY
LV1
TD1
TD4
P6 A
+
P6 B
P1 B
LEFT PUMP CYL. BACK
P2 B
RIGHT PUMP CYL. BACK
LV2
RV5
RV6
P1 A
LEFT PUMP CYL. FORWARD
P2 A
RIGHT PUMP CYL. FORWARD
LV3
LV4
SV1
SV2
RV7
RV8
TD6
P3 A
ROTOR CYL. BACK
P4 A
LEFT DISPENSE CYL. DOWN
P5 A
RIGHT DISPENSE CYL. DOWN
P6
BLOW OFF
SV1
RV4
RV1
RV2
P3 B
ROTOR CYL. FORWARD
RV9
P4 B
LEFT DISPENSE CYL. UP
RV10
P5 B
RIGHT DISPENSE CYL. UP
TO FIG. 14B

FROM FIG. 14A

R1
RV 1B
R2
RV 2B
TD2
RV 1A
RV 2A
TD3
210
LEFT AIR JET
RIGHT AIR JET
212
LV5
304
RV 4A
TD5
RV 4B
SV2
RV 5A
RV 7A
RV 9A
RV 6A
RV 8A
RV 10A

FLOWABLE PRODUCT METERING AND DISPENSING MACHINE

BACKGROUND DISCUSSION (a) The Prior Art

There has been a long felt need in many product manufacturing and processing industries for fast and accurate means to measure and to package flowable products. By "flowable" is meant, in its broadest sense, any substance which can be metered and moved through conduit means under pressure. This need has been particularly felt in the food processing industry where the requirement for speed and accuracy is compounded by the necessity to meet standards of sanitation and product unit integrity regulated and supervised by such governmental agencies as the U.S. Department of Agriculture and the U.S. Food and Drug Administration. Therefore, although not limited to food processing, the invention will be primarily discussed as applied in this environment because of the higher standards which must be met and the unique problems which are encountered in food processing applications.

One of the inadequacies of prior art machines for processing flowable products is the lack of means to repeatedly meter and dispense a unit product of the same weight and/or density from container to container. This problem is critical for several reasons. The ingredients of high quality food products are very expensive and random container over fill presents a serious problem of cost control. The problem is further complicated by the fact that both the U.S. Department of Agriculture and the Federal Food and Drug Administration are charged with the responsibility of protecting the public against being short weighted. With users of inaccurate prior art machines, a partial solution is to deliberately over fill each container. However, this solution is not an unmixed blessing because the practice of over fill is not only costly but could be considered not only by the Department of Agriculture and the Food and Drug Administration but also by various other governmental regulatory agencies, such as the Federal Trade Commission, as an unfair method of competition.

Another problem of prior art food processing machines is their vulnerability to food contamination. These machines are difficult and time consuming to clean, particularly if adequate cleaning requires field stripping of many of the machine's component parts. Reassembling after cleaning is also time consuming with prior art machines, especially because of the tendency for disassembled parts to become misplaced or lost during the cleaning process.

Food processing machines are required to be cleaned between each product run of food and this may be several times a day. Cleaning methods include hosing down all machine parts with steam, hot water, caustic and/or acid solutions and/or combinations of any or all of these cleaning means. Exposure of prior art machines, equipped with electrical drives and controls, to these cleaning techniques has proved to be devastating. This is particularly so with respect to electronic controls which have an exceedingly low resistance to moisture.

Additionally, many prior art machines can only be taken apart and reassembled by highly trained personnel. These machines also require skilled electrical technicians to reprogram them before each new run.

Other problems of prior art food processing machines include their inability to synchronize the movement of their dispensing heads with the movement of the conveyorized containers; and failure to confine a charge of food to within its intended container without overlap and splatter on the edges of the containers, other containsers, the conveyor and the floor.

These and other deficiencies of prior art flowable product dispensing machines have been remedied by the subject invention.

(b) General Discussion of the Invention

This invention overcomes the faults of the above discussed prior art machines by providing a mechanism which is programmed, timed and operated entirely by fluid pressure means, thus rendering it impervious to the attrition of moisture. These machines, already in the field, are routinely cleaned several times a day without any history of down time because of moisture created malfunctions.

The frame, product storage reservoir, mounting plates and accessories are, wherever feasible, fabricated from stainless steel plates and stainless steel seamless tubing. Novel configuration of the product storage reservoir assures improved product flow into a transparent acrylic distribution manifold. Novel product metering and pumping means consistently convey accurately measured product units to one or more dispenser heads mounted for orbital movement over the path of conveyorized product containers. Novel means are provided to chain drive the dispenser heads in their orbital paths without commonly experienced chain binding and lock-up between sprockets. The accuracy of the dispenser orbital paths and novel dispensing means assures that the product will be deposited within its intended container, rather than on its edges, a following container, the conveyor or on the floor.

The sub-components of the machine are designed for ease of cleaning without removal from the main frame. The machine is also designed for ease of maintenance and the simplicity of its parts and fasteners enables it to be quickly and easily field stripped and reassembled by unskilled labor. Once assembled, the set up time for any product run is literally only a matter of seconds. Also, a product run machine set up can be performed by unskilled labor.

Finally, based on reports filed by U.S. Department of Agriculture inspectors indicating that the commercial embodiment of the machine is constructed of acceptable materials, performs satisfactorily, and can be maintained in good sanitary condition, the machine has been approved for use in federally inspected meat and poultry plants.

OBJECTS OF THE INVENTION

It is therefore among the objects of this invention to provide a product processing machine which: meets the requirements of all federal regulatory agencies; is made of contamination free materials; is easy to clean; can be easily hosed down; assembles and disassembles quickly without the need for numerous or special tools; is moisture resistant; is pneumatically powered, programmed and timed; is adapted to be driven in synchronization with a conveyor; is adaptable to simultaneously fill one or more containers; is capable of cycling up to one hundred and fifty times per minute; dispenses flowable substances into conveyorized containers passing beneath a dispensing head up to one hundred and fifty times per minute without misdirecting portions of the substance onto the conveyor or into the following container or containers; dispenses a flowable substance up to one hundred and fifty times per minute without permitting residue to accumulate on the dispensing head; employs an orbiting dispensing head that travels in the same direction as the container during the dispensing portion of the cycle; includes a self-cleaning dispensing head; can be easily moved from one conveyor to another; can quickly and easily adjust the amount of product dispensed from line to line; can quickly and easily adjust the food charge while on line; cannot cycle inadvertently; and which requires no electronic components susceptible to failure in a moisture laden environment.

These and other objects features and advantages of this invention will become apparent in view of the following detailed description of the preferred embodiments shown and described herein, and as illustrated in the accompanying drawings in which:

THE DRAWINGS

Reference will now be made to the Figures in greater detail.

DETAILED DISCLOSURE OF THE INVENTION

Figure 1:
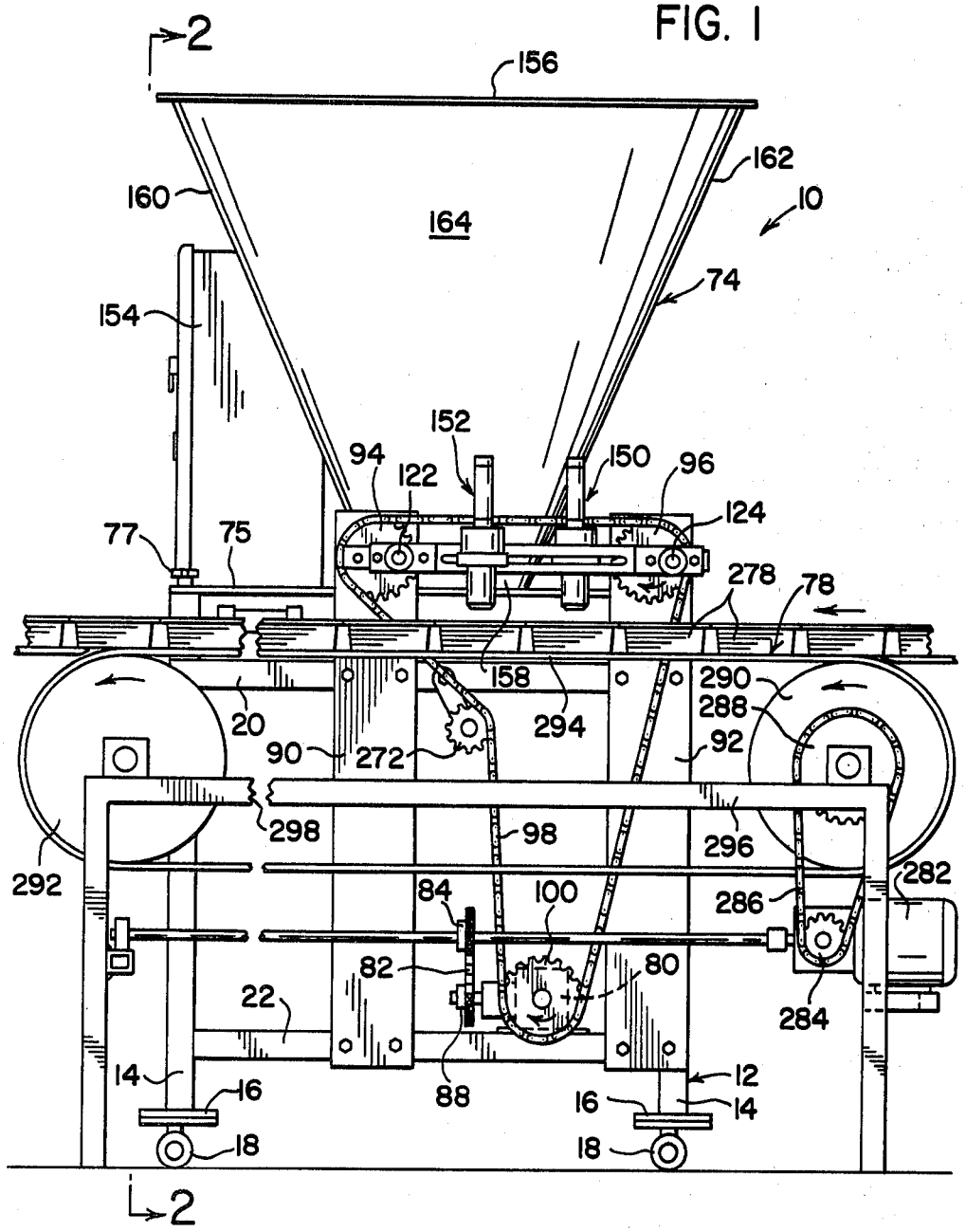
FIG. 1 is a front elevation of a preferred embodiment of the invention.
Figure 2:
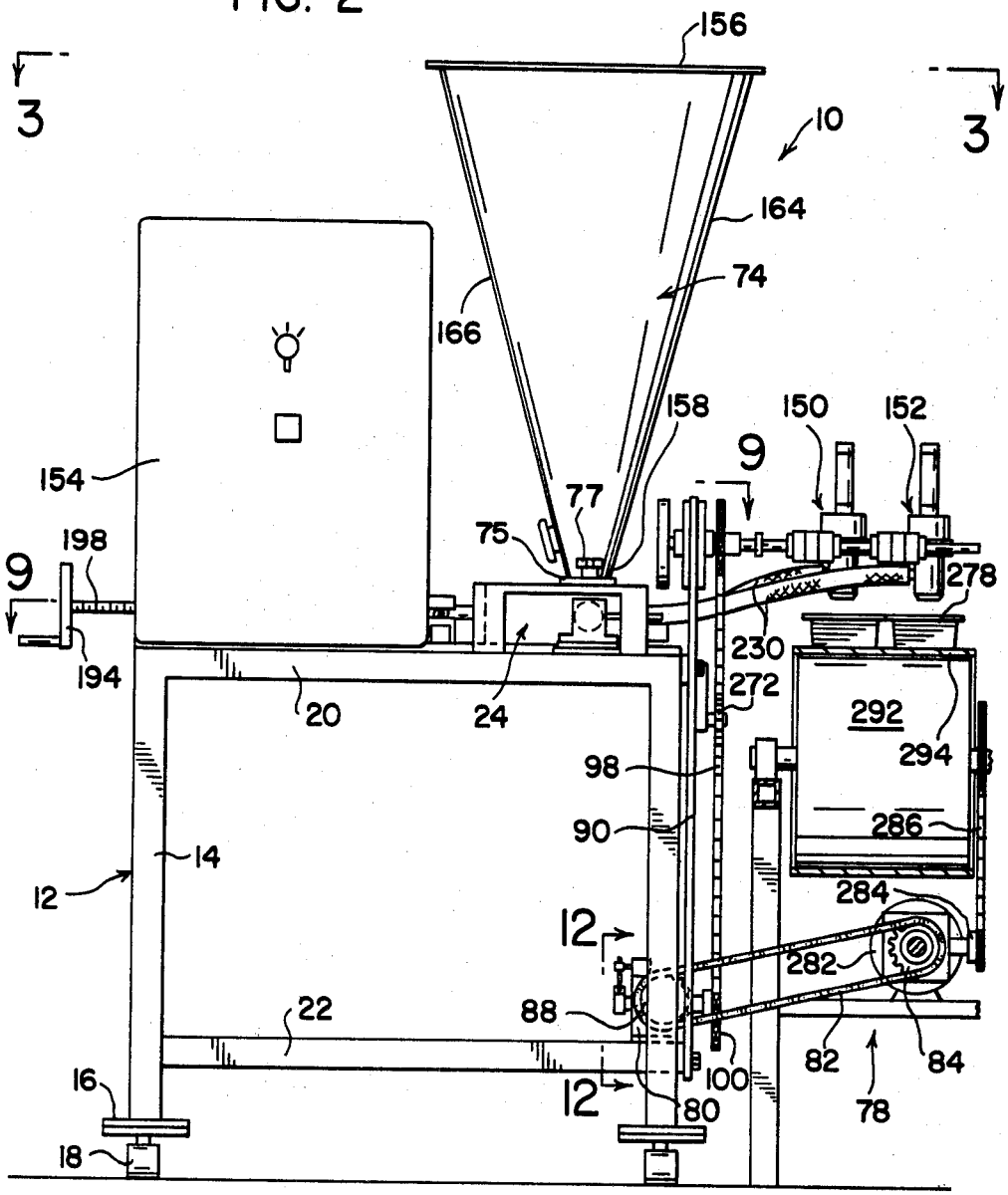
FIG. 2 is a left side elevational view of the embodiment of the invention shown in FIG. 1 taken along the line 2—2 of FIG. 1.
Figure 3:
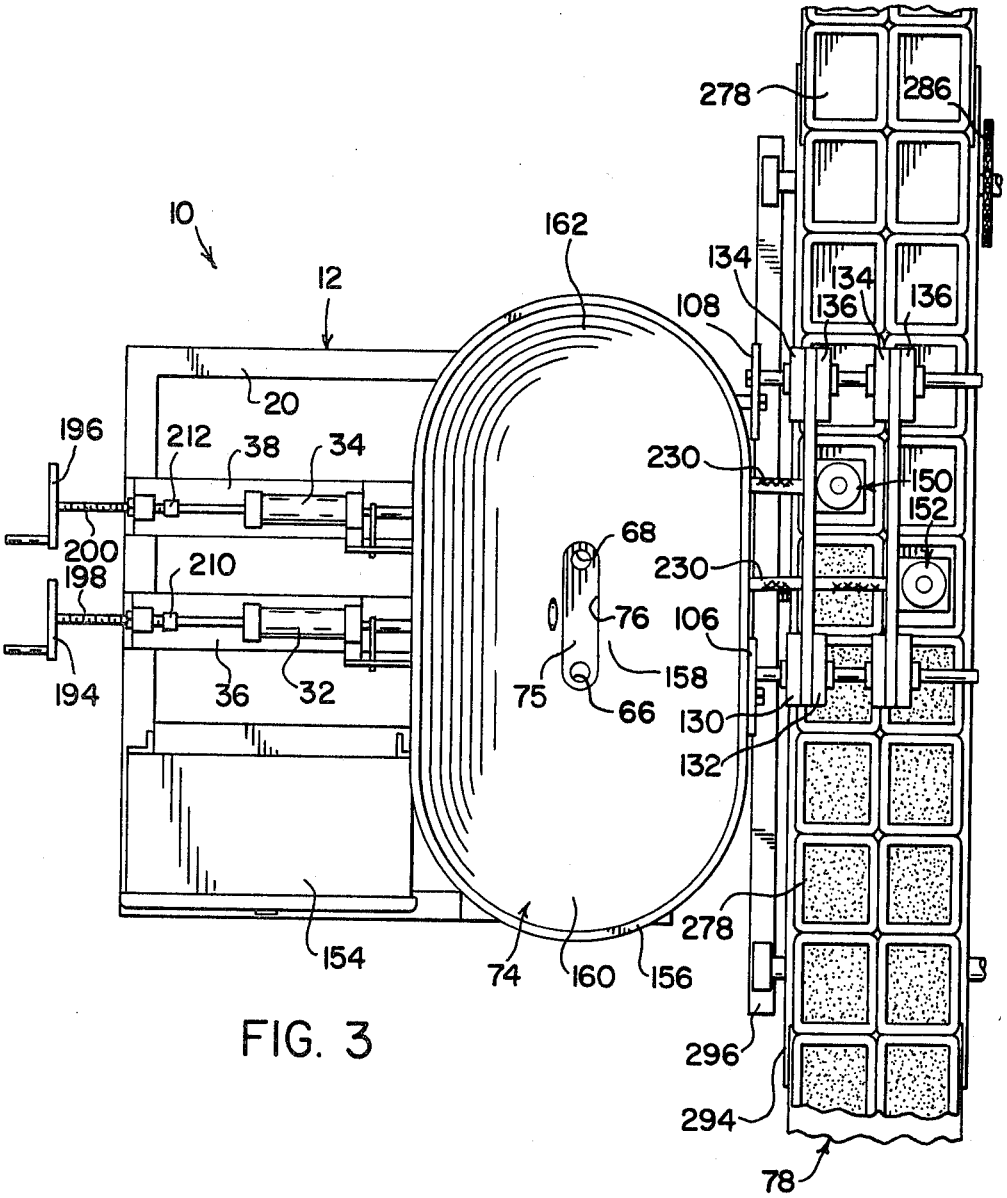
FIG. 3 is a plan view of the embodiment of the invention shown in FIG. 1 taken along the line 3—3 of FIG. 2.

A preferred embodiment of the invention 10, as shown in FIGS. 1, 2 and 3, comprises a rectangular frame 12, having as legs 14 four vertical seamless stainless steel square tubes of equal length with floor pads 16 welded to their bottom edges. Castors 18 are secured to the undersides of the floor pads 16. The top edges of legs 14 are joined by four like top horizontal stainless steel tubes 20 welded thereto. Intermediate the top and bottom edges of legs 14 are four stainless steel tubes 22 welded to legs 14 and parallel to the top tubes 20.

Figure 9:
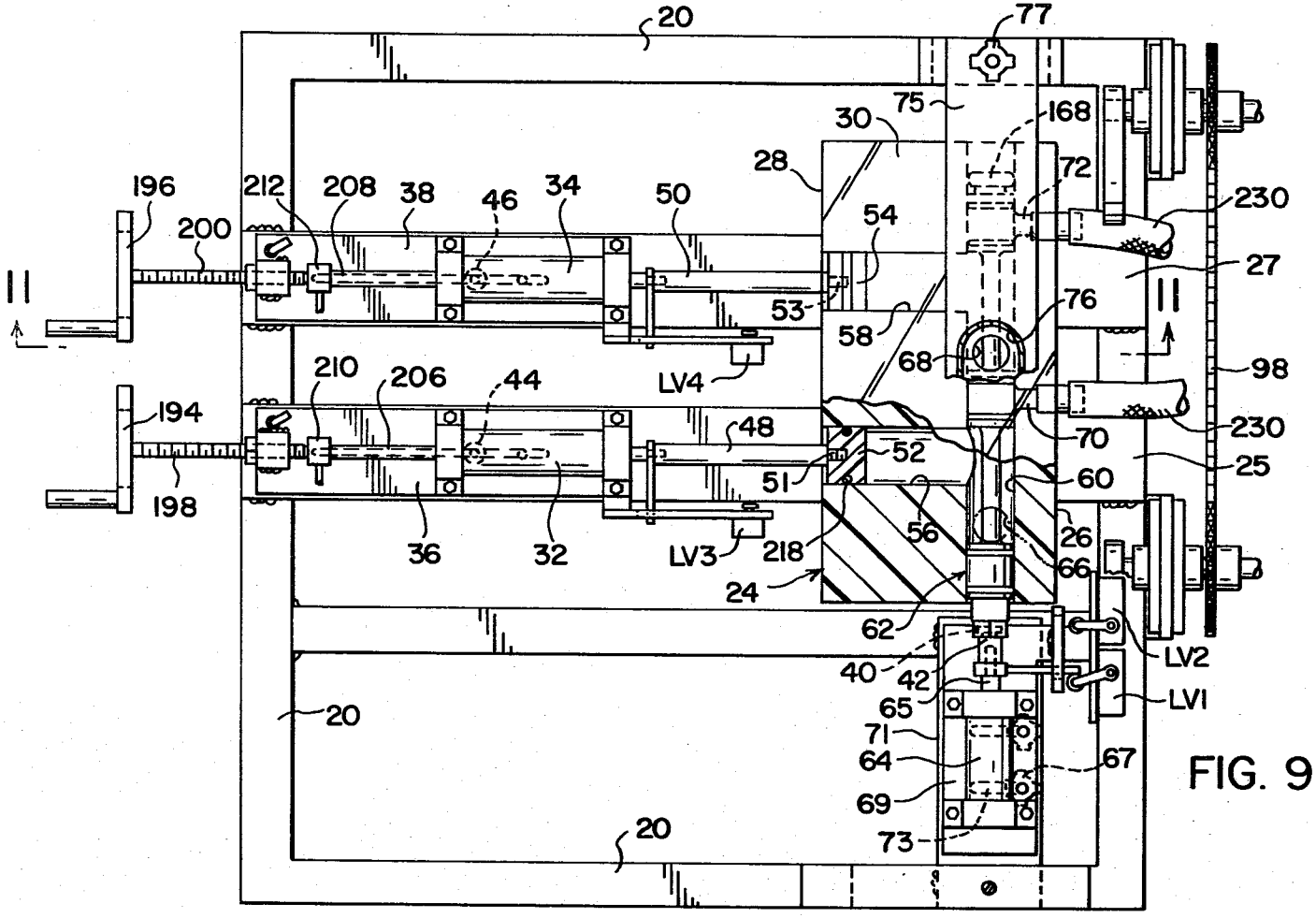
FIG. 9 is a fragmentary plan view, partially in section, taken along the line 9—9 of FIG. 2, showing the plungers in the retracted position.
Figure 11:
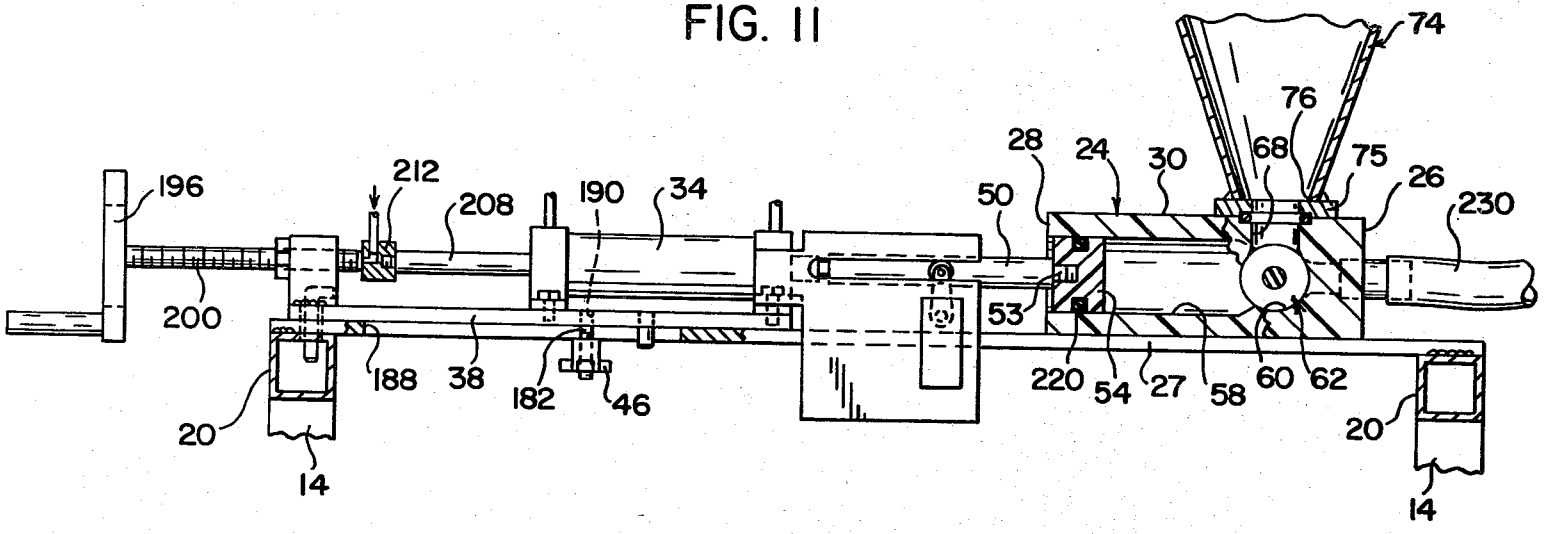
FIG. 11 is a fragmentary elevational view, partially in section, taken along the line 11—11 of FIG. 9.

As best shown in FIGS. 2, 9 and 11, a manifold 24 is mounted on slotted stainless steel support plates 25 and 27 which are welded to top tubes 20. The manifold 24 is formed of a transparent acrylic plastic, is rectangular, and is aligned with a front vertical face 26 parallel to the front vertical plane of the frame 12. Rear manifold face 28 is parallel to front face 26 and is normal to top manifold face 30. A pair of pneumatic cylinders 32 and 34 are mounted on stainless steel mounting plates 36 and 38, respectively, which are removably secured to slotted frame members 25 and 27 by fast release hand knobs 44 and 46. The piston rods 48 and 50 of cylinders 32 and 34 are coupled by threaded means 51 and 53 to a pair of Teflon plungers 52 and 54, sealed with O-rings 218 and 220. A pair of plunger holes 56 and 58 are formed in the rear face 28 of manifold 24 to receive plungers 52 and 54, respectively, for horizontal pumping action in manifold 24.

Figure 10:
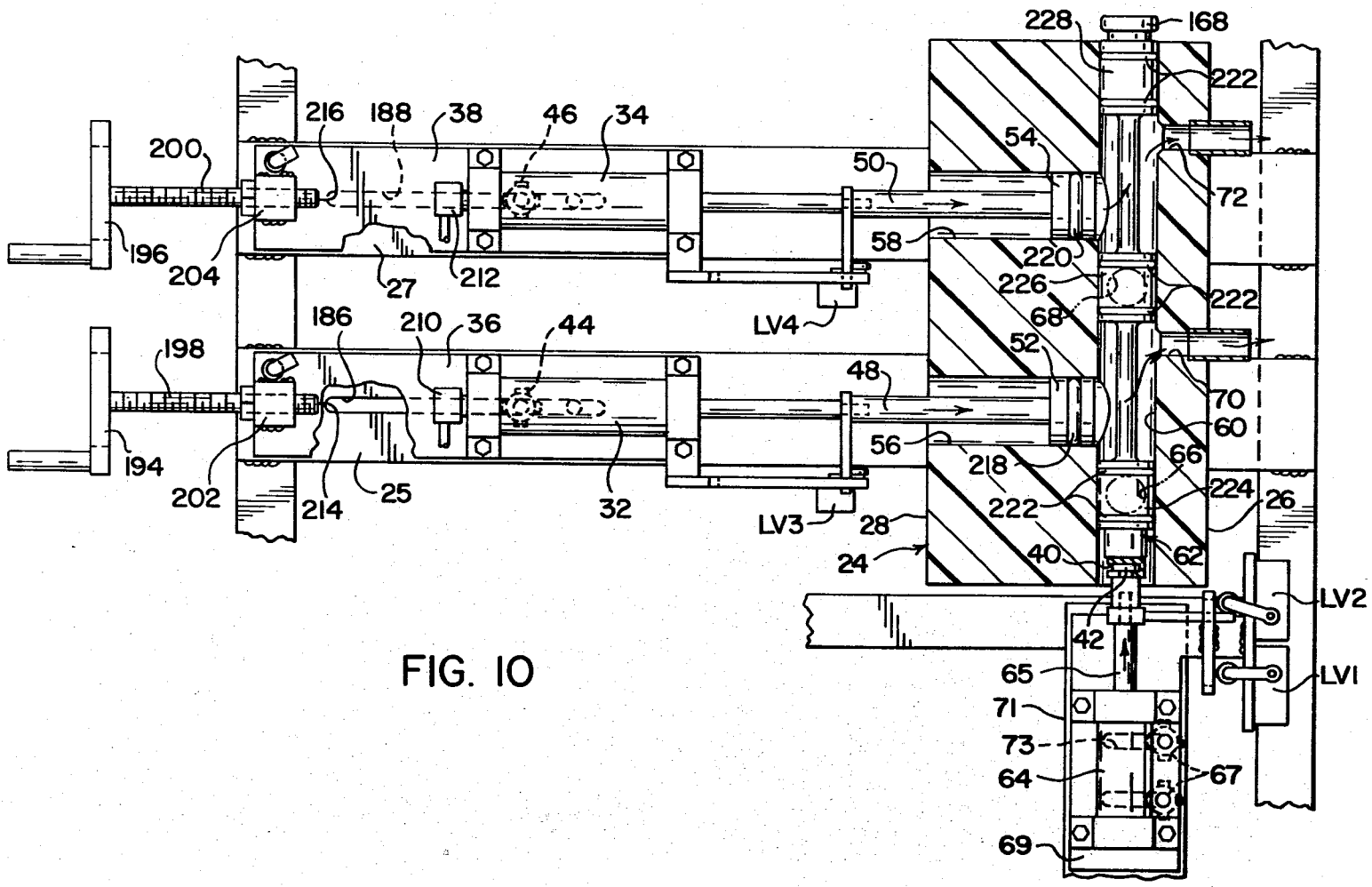
FIG. 10 is a fragmentary plan view, partially in section, similar to FIG. 9, showing the plungers in the forward position.

As best shown in FIGS. 9 and 10, a cylindrical chamber 60 is provided in manifold 24 normal to and intersecting plunger holes 56 and 58 to receive an O-ring sealed spool valve 62 adapted to be reciprocated therein by piston rod 65 of pneumatic cylinder 64. Spool valve 62 is provided with a T-slot 40 to receive the T-head end 42 of piston rod 65 for quick disengagement. Cylinder 64 is mounted on plate 69 which is secured to transverse slotted plate 71 welded to frame members 20. Slots 73 and quick release knobs 67 permit plate 69 to slide rearwardly over the top face of plate 71 for quick release of piston 65 from valve 62. Ports 66 and 68, FIGS. 3, 9 and 10, are formed in the top face 30 of manifold 24 for intersection with chamber 60 as are ports 70 and 72 formed in the front face 26 of manifold 24. A funnel-shaped vat 74 is mounted on plate 75 which is secured to frame 12 with quick release hand knobs 77. A bottom opening 76, FIG. 3, in vat 74 and plate 75 straddles the pair of ports 66 and 68.

Figure 4:
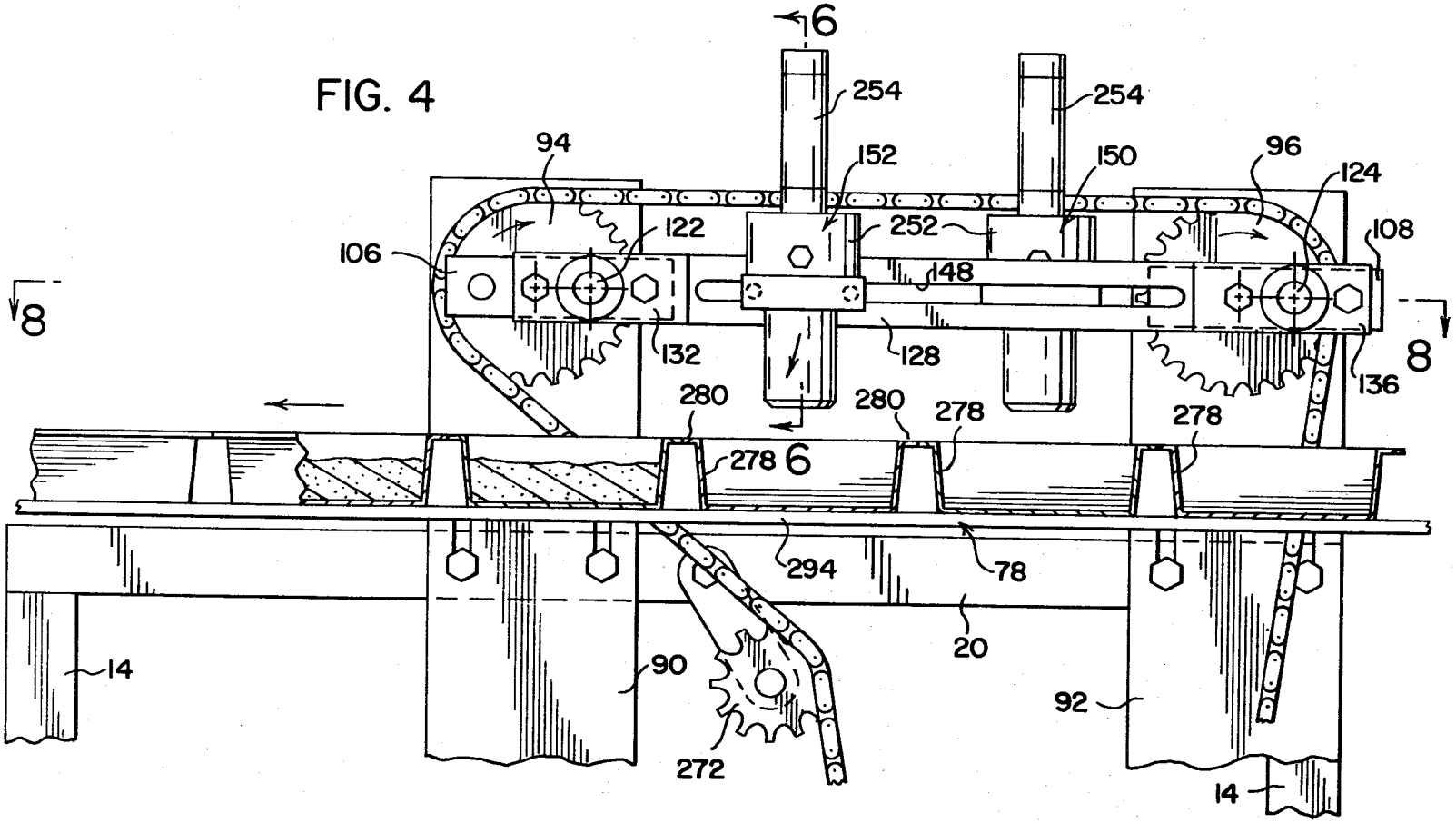
FIG. 4 is a fragmentary enlarged front elevational view, partially in section, of the orbital dispenser subassembly in the up position.
Figure 5:
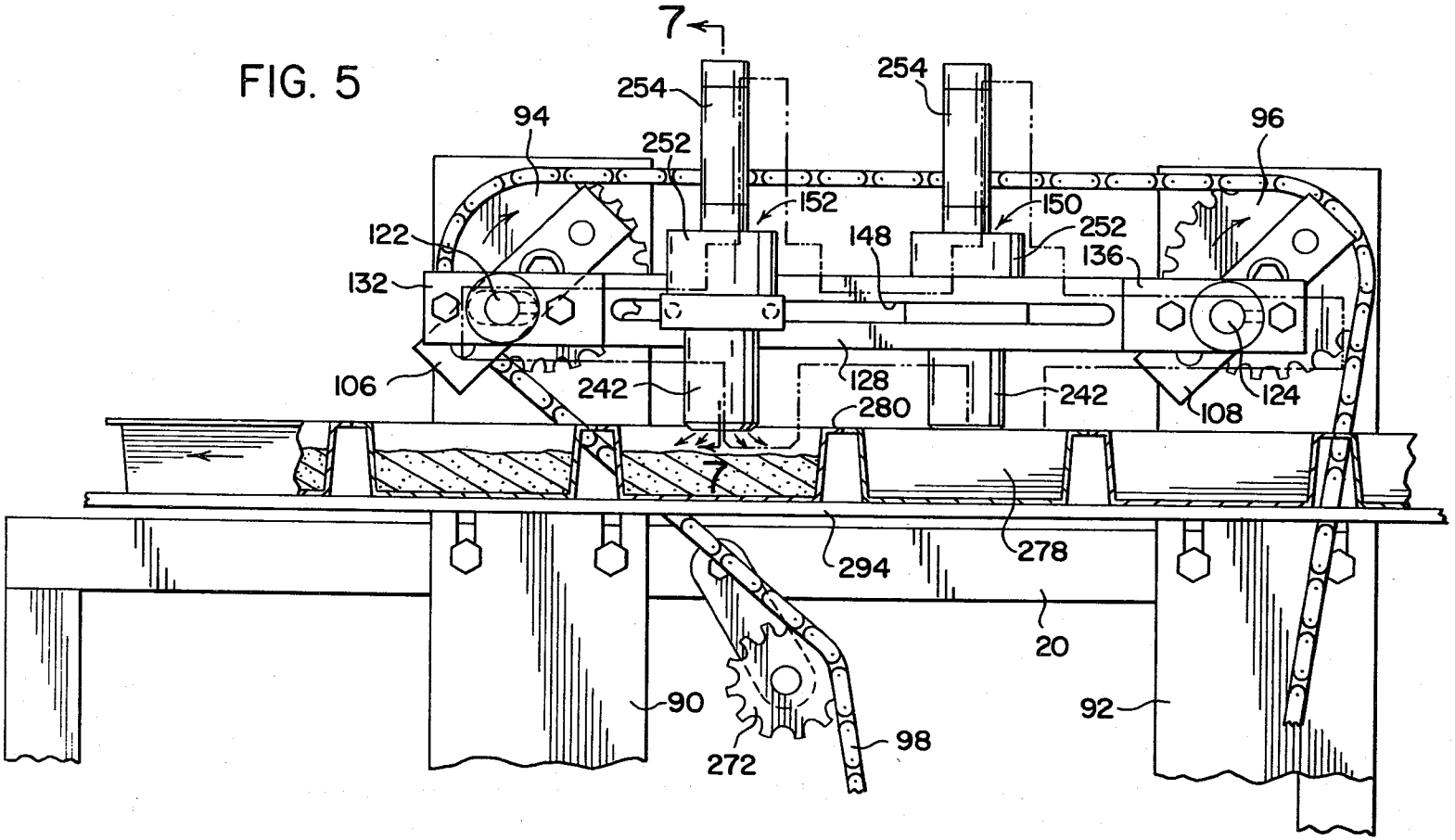
FIG. 5 is a fragmentary enlarged front elevational view, partially in section, of the orbital dispenser subassembly in phantom in the bottom position and to the left thereof in the blowdown position.
Figure 8:
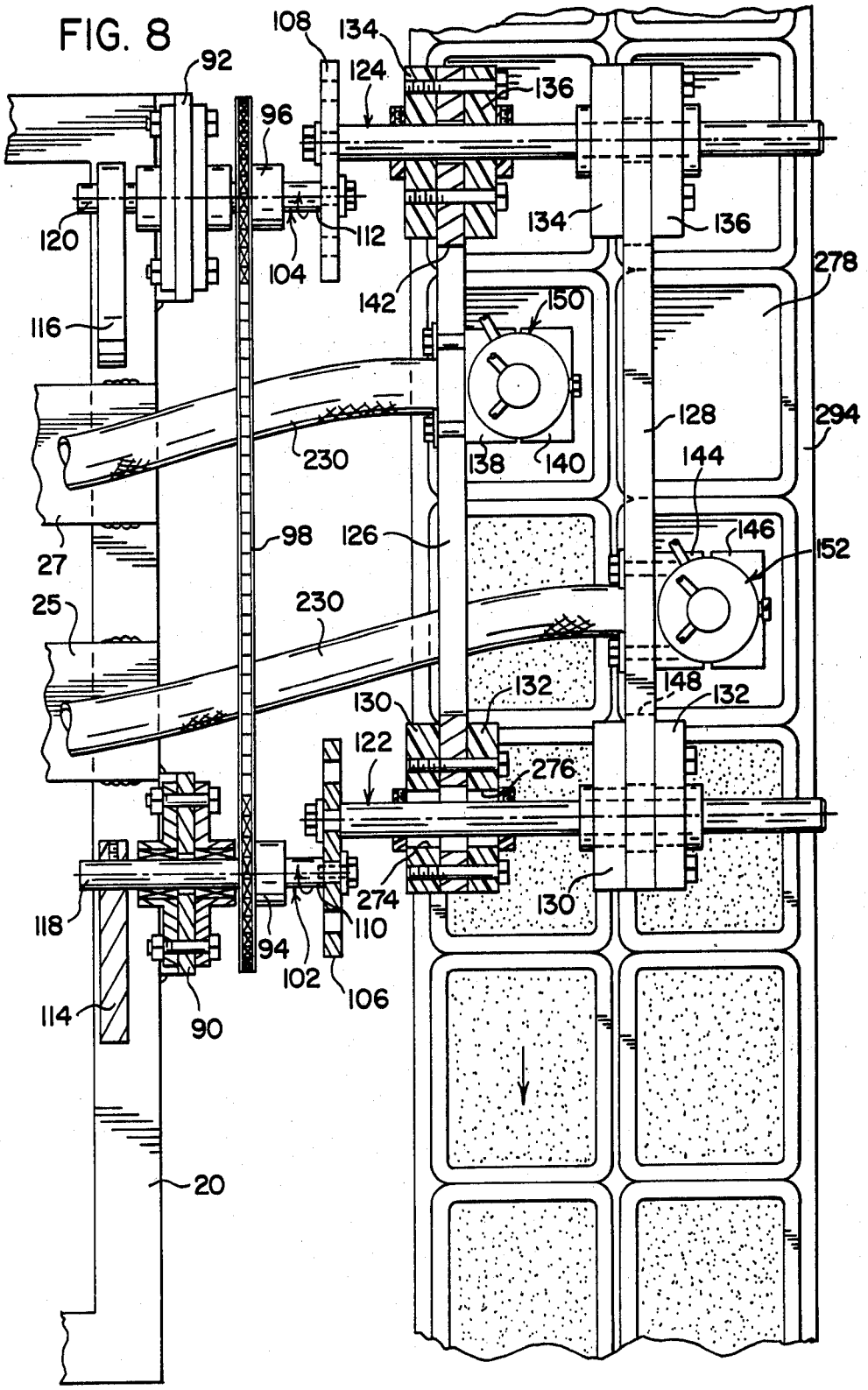
FIG. 8 is a fragmentary plan view, partially in section, of the orbital dispenser sub-assembly shown in FIG. 4.

Returning to FIGS. 1 and 2, means are shown for synchronizing the subject invention 10 with a conveyor 78. A gear box 80 is secured to front lower cross frame member 22 of frame 12 and is driven by conveyor chain 82, conveyor drive sprocket 84, gear box idler sprocket, not shown, and gear box driven sprocket 88. A pair of mounting plates 90 and 92, secured to front upper and front lower cross frame members 20 and 22, rotatably carry a pair of stub shafts 102 and 104, FIG. 8, driven by sprockets 94 and 96, respectively, which are concentrically mounted on these stub shafts and are, in turn, driven by chain 98 and gear box drive sprocket 100. Eccentric plates 106 and 108, see also FIGS. 4 and 5, are secured to the front ends 110 and 112 of stub shafts 102 and 104, respectively, and are rotatably driven thereby. Eccentric plate counterweights 114 and 116, FIG. 8, are mounted on the far ends 118 and 120 of stub shafts 102 and 104, respectively.

A pair of orbital frame support shafts 122 and 124, parallel to stub shafts 102 and 104, are mounted in eccentric plates 106 and 108, respectively, and are eccentrically offset from the centers of rotation of the eccentric plates. A pair of parallel, spaced apart, orbital frame slotted cross supports 126 and 128 transversely span dispenser head support shafts 122 and 124 and are mounted between a pair of Teflon bearing blocks 130 and 132 on the left and a pair of Teflon bearing blocks 134 and 136 on the right, as best seen in FIG. 8. Dispensing head split mounting plates 138 and 140 are threaded fastener secured through the slot 142 of slotted cross plate 126 and dispensing head split mounting plates 144 and 146 are threaded fastener secured through slot 148 of slotted cross plate 128. Dispensing head 150 is removably secured between split plates 138 and 140, and dispensing head 152 is removably secured between split plates 144 and 146.

Figure 14A:
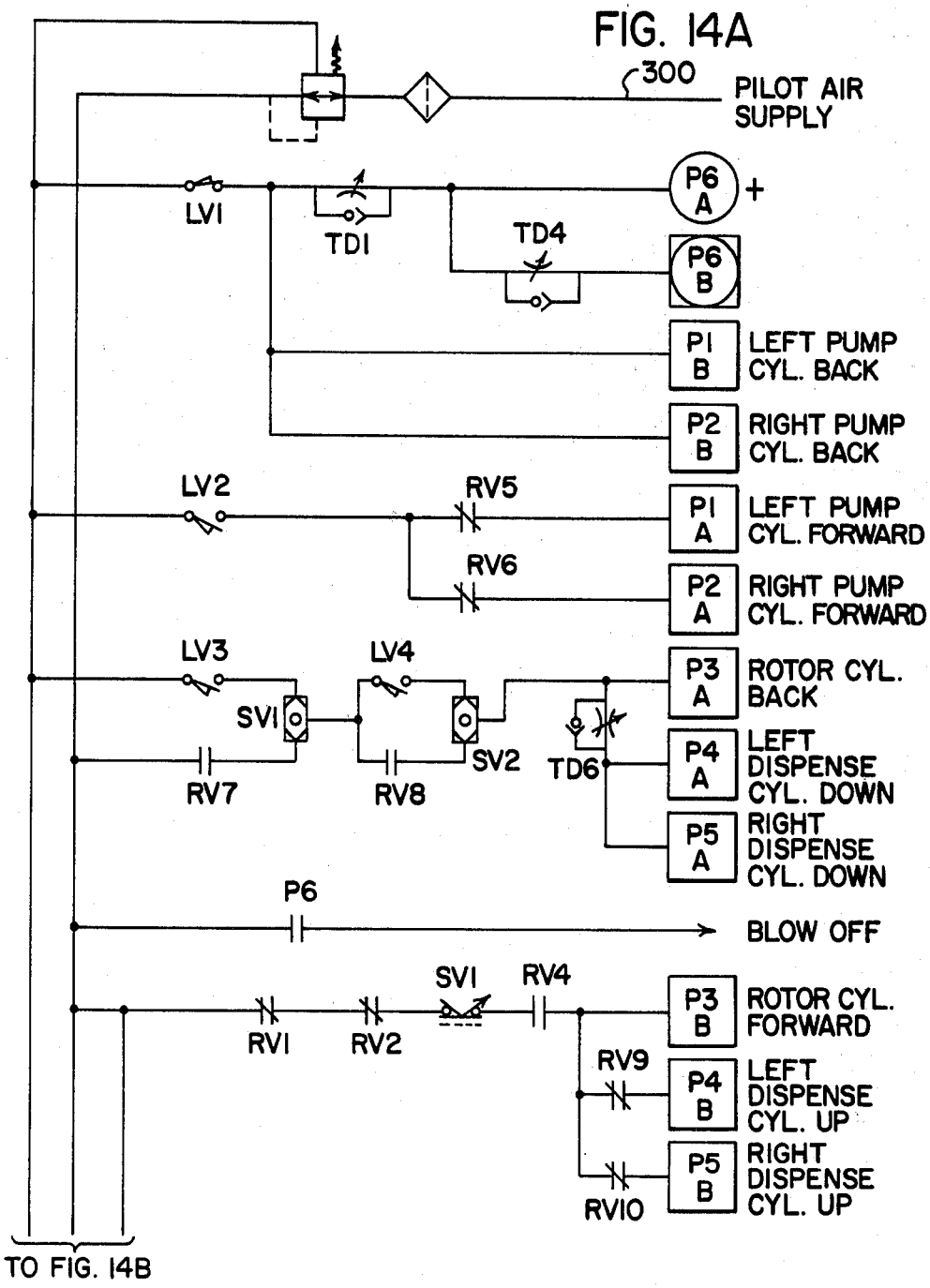
Figure 14B:
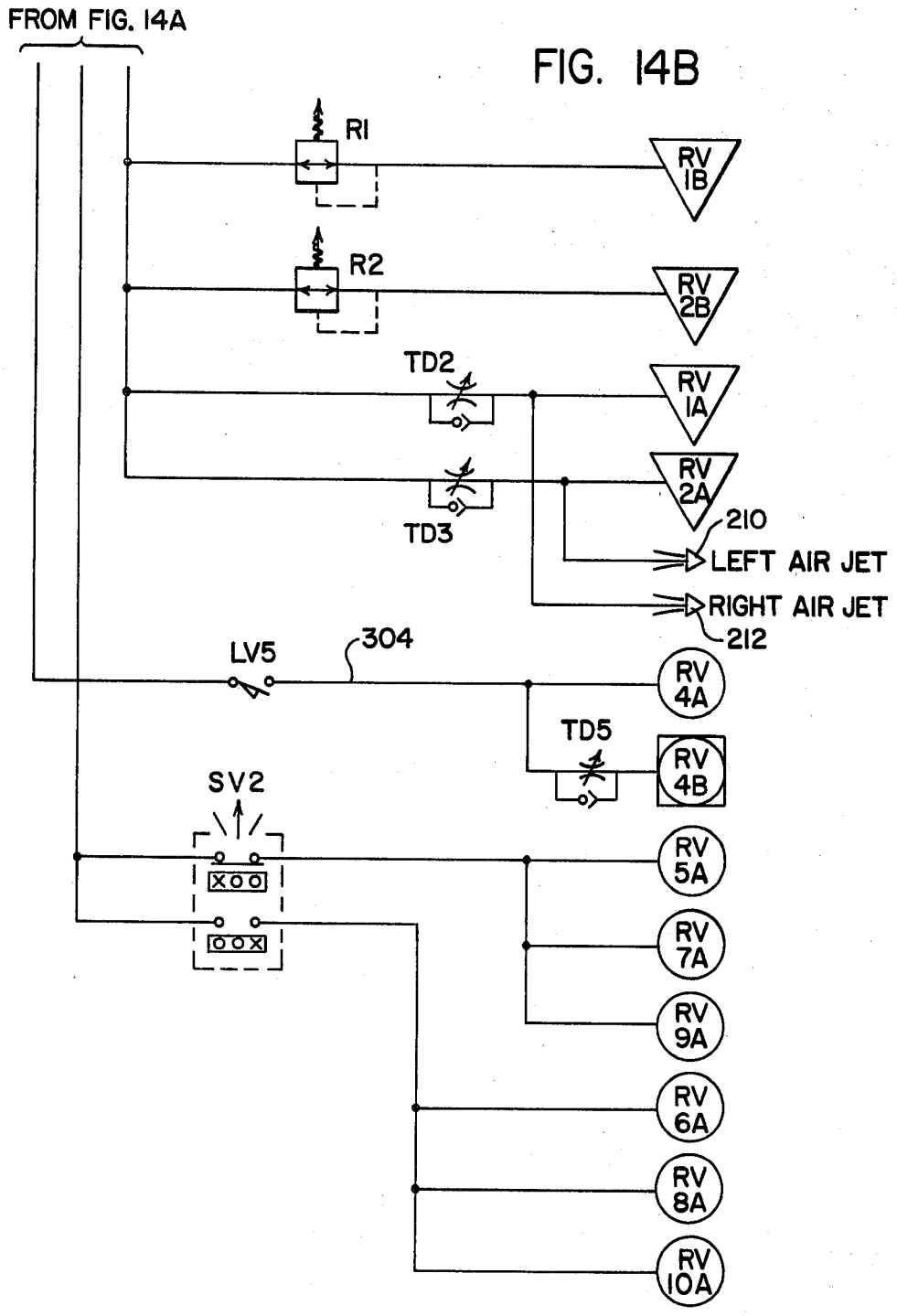

A pneumatic program panel box 154 is shown mounted on the left top side of frame 12 for housing the pneumatic program means shown schematically in FIGS. 14A and 14B. This box is NEMA 4 rated to withstand the various steam and chemical baths used in sanitizing the equipment.

THE DISPENSING VAT

The stainless steel vat 74, FIGS. 1, 2 and 3, is generally funnel-shaped, being wider at the top 156 and narrower at the bottom 158. Viewed from FIGS. 1 and 2, it is seen that semi-conical side panels 160 and 162 are welded to generally flat front and back panels 164 and 166. It has been discovered through experimentation that the so-called "bridging" in prior art vats has been minimized with the configuration of the vat 74. By inclining the front, back and side panels outwardly about 20° from the vertical, the interior surfaces of the vat guide the product directly to the manifold ports 66 and 68 without bridging and resultant product cavitation. When cavitation occurs in the vat, a misfeed in the manifold may occur, resulting in a short weight dispensed product. It has been found that this panel inclination is critical within a range of approximately ±5°. With this configuration, not only do the interior wall surfaces better direct the product to the ports 66 and 68, product residue does not deposit on the interior surface or on the bottom of the vat, but instead is continuously swept into the ports. Furthermore, it has been observed that it does not matter what percentage of the vat is filled with a product, the same density and weight of product is consistently received through ports 66 and 68 into the distribution manifold 24.

As already noted, the entire vat 74 may be quickly removed from the frame 12 for cleaning merely by backing off left and right quick release hand knobs 77.

THE MANIFOLD SUB-COMBINATION

Referring to FIG. 9, therein is shown the spool valve 62 retracted to the left wherein vat ports 66 and 68 are opened; dispenser ports 70 and 72 are closed; and plungers 52 and 54 in holes 56 and 58 have just fully withdrawn to the rear of the manifold 24. Assisted by gravity, the product is drawn by suction from vat 74 through ports 66 and 68 into spool valve chamber 60. It is an important feature of the invention that plungers 52 and 54 withdraw rearwardly faster than the product can fill the spaces in chamber 60 and holes 56 and 58 vacated by the plungers. Accordingly, the product is not undesirably compressed and compacted against stationary plunger heads 178 and 180 prior to being moved out of the manifold during the following portion of the cycle. Spool valve 62 is then shifted to the right by piston rod 65 of pneumatic cylinder 64, FIG. 10, to close ports 66 and 68 and to open ports 70 and 72. Plungers 52 and 54 are moved forward in holes 56 and 58 by cylinders 32 and 34 to force the food product out of chamber 60 and through dispensing ports 70 and 72. Thereafter, spool valve 62 is again shifted to the left and plungers 52 and 54 are again withdrawn to rear of manifold 24 as shown in FIG. 9, thereby completing one dispensing cycle of operation and drawing in another charge of cavitation-free product preparatory for the next cycle.

As already noted, cylinders 32 and 34 are mounted on plates 36 and 38 which are slidably adjustable on the surfaces of longitudinally slotted support plates 25 and 27. Fast release hand knobs 44 and 46 have threaded stud portions 182 which extend through slots 186 and 188 of slotted plates 25 and 27 to be received in threaded holes 190 in the undersides of cylinder mounting plates 36 and 38. With this arrangement, by merely loosening hand knobs 44 and 46, the cylinders 32 and 34 may be pulled back, but not detached from the frame, for cleaning purposes.

From FIGS. 9 and 10 it will be seen that hand wheels 194 and 196 are mounted on threaded shafts 198 and 200 which are threaded through support blocks 202 and 204. The threaded shafts 190 and 200 are in concentric alignment with sensing rods 206 and 208 extending rearwardly from cylinders 32 and 34, respectively. These rods are integrally secured to the double acting pistons housed in cylinders 32 and 34 for movement therewith. As sening rods 206 and 208 move rearwardly toward hand wheel adjusting shafts 198 and 200 during the end of a dispensing cycle, air jet sensors 210 and 212 detect the closing of the sensors with the ends 214 and 216 of hand wheel adjusting shafts 198 and 200. After a predetermined closing distance has been reached between air jet sensors 210 and 212 and ends 214 and 216 of hand wheel adjusting shafts 198 and 200, the air jet sensors signal cylinder actuator means to arrest further rearward movement of sensing rods 206 and 208 and signal the spool cylinder 64 to again shift spool valve 62 to close vat ports 66 and 68 and to open dispensing ports 70 and 72.

Thus, by a simple adjustment in or of the ends 214 and 216 of the hand wheel shafts 198 and 200, the lengths of the strokes of the cylinders 32 and 34 are easily and quickly adjusted. Since the final rearward positions of the cylinder driven plungers 52 and 54 in the manifold 24 are determinative of the volume and/or weight of the product charge in manifold chamber 60 and plunger holes 56 and 58, this charge can be quickly and accurately adjusted by rotation of hand wheels 194 and/or 196. The adjustments may be made by unskilled labor either during runs or between runs.

Referring again to manifold block 24, best shown in FIGS. 9 and 10, it will be noted that spool valve 62 is are fitted with O-rings 222 on each end of spools 224, 226 and 228. Generally, O-rings not recommended by O-ring manufacturers for sealing between reciprocating cylindrical parts because of the tendency for O-rings to twist and to roll out of their grooves during reciprocation between parts. In lieu thereof, O-ring lip reinforced reciprocating seals are recommended, such as disclosed in U.S. Pat. Nos. 3,169,776 and 3,342,500. However, in view of the sharp lines of intersection between holes 56 and 58, ports 66 and 68 and ports 70 and 72 with chamber 60, it was discovered that lip seals were soon destroyed. O-rings were then tried, even though not recommended, and they too were cut by these intersections and soon destroyed. Finally, after considerably experimentation with numerous other types of seals, it was discovered that by applying a slight radius on all lines of intersection in the manifold, the O-rings would not cut and that they provided good sealing over the normal life span of the O-rings, even though they were reciprocated across the manifold ports up to three hundred times a minute.

As earlier mentioned, spool valve 62 is provided with means to quick disconnect from drive cylinder piston shaft 65. This is effected by simply loosening hand knobs 67, wherein cylinder 64 is free to be shifted rearwardly because of slots 73 in plate 71. Hand grip 168 enables spool valve 62 then to be manually pulled from left to right out of valve chamber 60 of manifold 24. By loosening hand knobs 44 and 46, cylinders 32 and 34 may be pulled rearwardly as permitted by slots 186 and 188 of plates 25 and 27, whereby threadedly engaged plungers 52 and 54 are removed from holes 56 and 58 of manifold 24. In like manner, the vat 74 is removable from manifold 24 by merely backing off hand knobs 77 from opposite sides of plate 75. Thus, disassembly of the manifold 24 only requires a few seconds. The manifold 24, manifold spool valve 62 and plungers 52 and 54 are then readily cleaned. When cleaining is completed the re-assembly also only requires a few seconds.

THE DISPENSING HEAD SUB-COMBINATION

Manifold ports 70 and 72 are connected by flexible plastic hoses 230 to dispensing head hose sleeves 233. The dispensing heads 150 and 152 each comprise bodies 242; plug valves 244 with air passages 246; piston rods 248 with T-heads 250; caps 252, pneumatic cylinders 254; air lines 256; intake ports 257; and dispensing ports 258.

Figure 6:
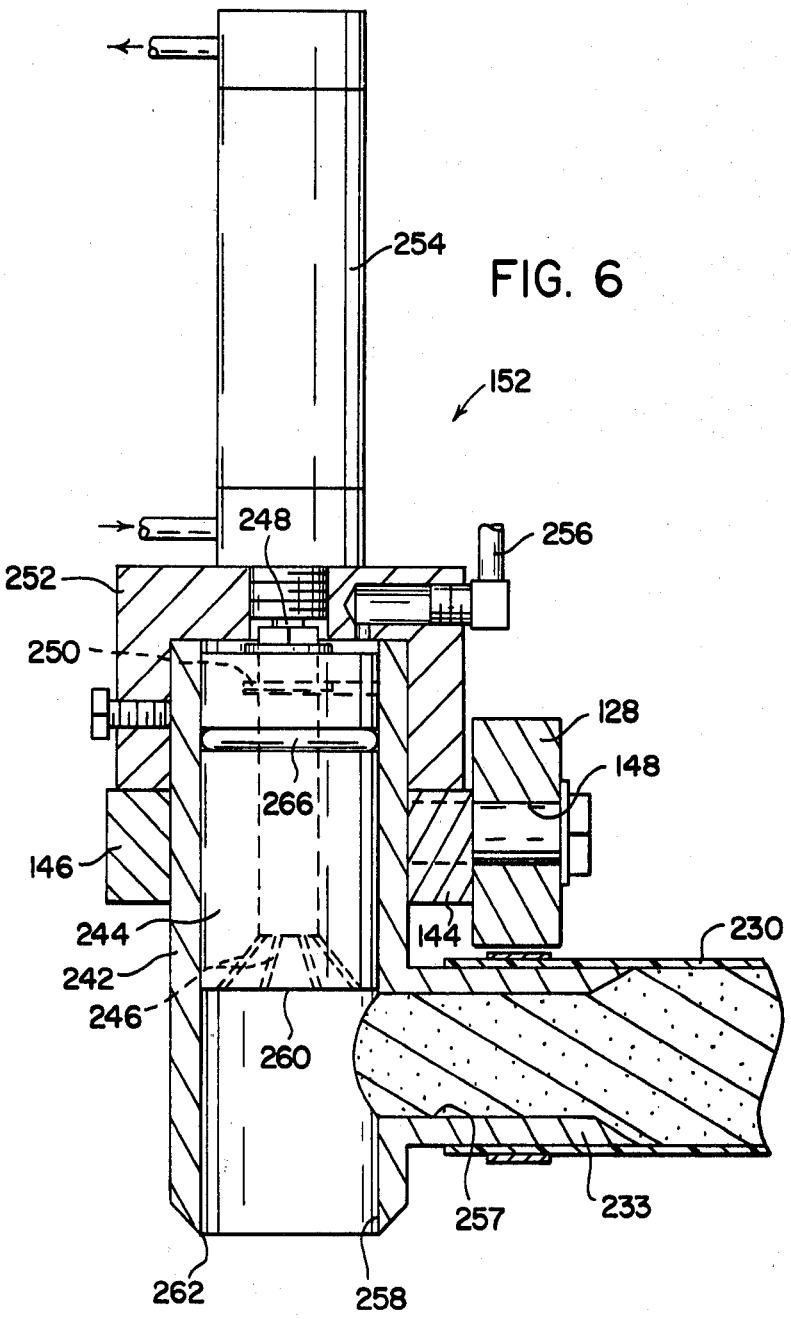
FIG. 6 is a fragmentary enlarged side elevational view, partially in section, of a dispensing head subassembly taken along the line 6—6 of FIG. 4, showing the plug valve in the open position.
Figure 7:
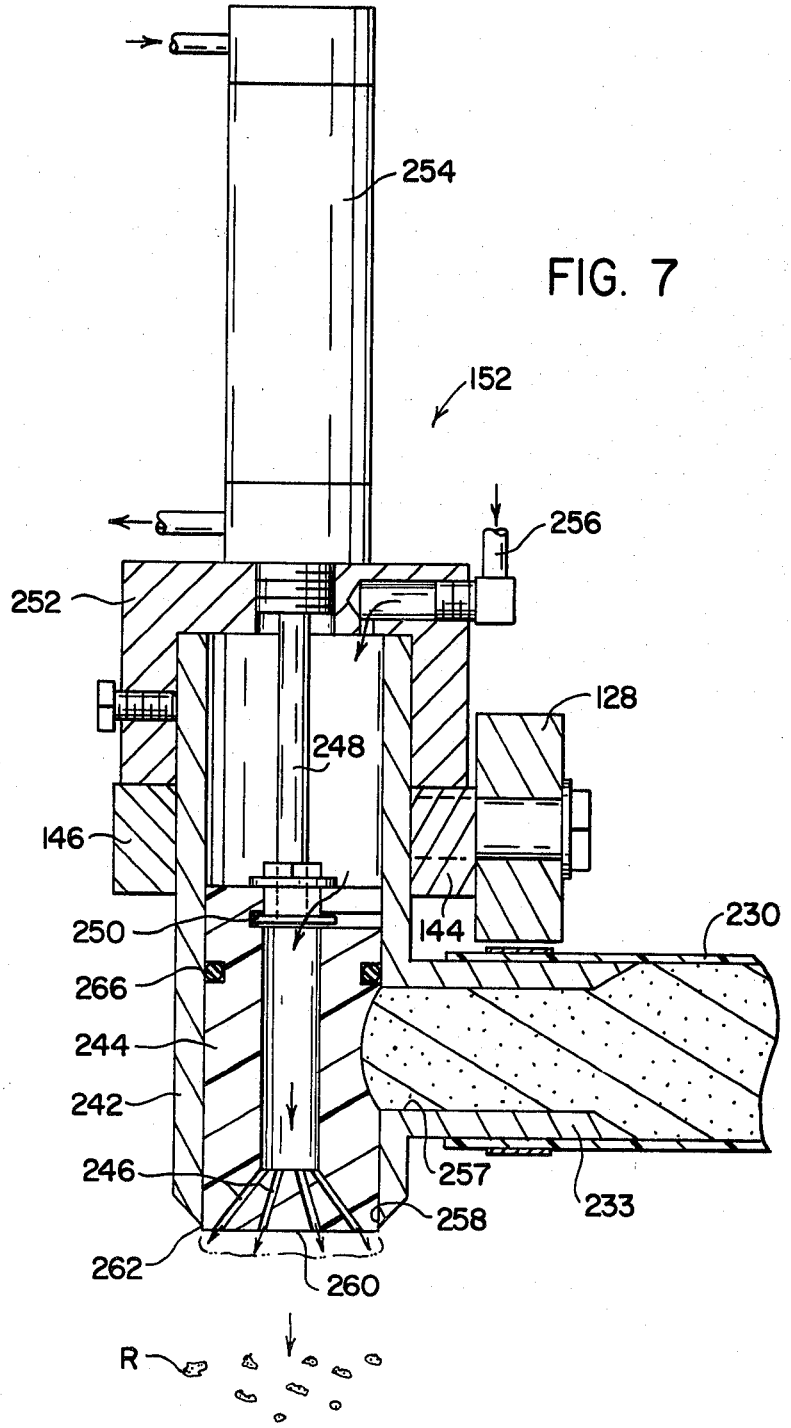
FIG. 7 is a fragmentary enlarged side elevational view partially in section, of a dispensing head subassembly taken along the line 7—7 of FIG. 5, showing the plug valve in the closed position.

When manifold 24 is in the mode shown in FIG. 10, dispensing heads 150 and 152 are in the mode shown in FIG. 6. The plug valves 244 are withdrawn upwardly to open intake ports 257 and to permit the product to move from manifold dispensing ports 70 and 72 through hoses 230 into dispensing head bodies 242 and out dispensing ports 258, After a timed interval, approximately when plungers 52 and 54 are within ¼" of the end of their forward strokes in manifold plunger holes 56 and 58, plug valves 244 move down until their lower surfaces 260 extend about 1/16" beyond edges 262 of dispensing ports 258. In so doing, plug valves 244 close intake ports 257 and sweep all food product residue from the interiors of dispensing head body 242. When plug valves 244 reach the ends of their downward strokes, pluses of air from air lines 256 through air passages 246 remove any remaining product residue R from the bottom surfaces 260 of plug valves 244. Plug valves 244 are then delay timed to withdraw upwardly to the top of their strokes, as seen in FIG. 6, thereby again opening intake ports 257 in readiness for the next cycle.

Plug valves 244 are equipped with O-rings 266 to seal against the interiors of dispenser head bodies 242.

THE ORBITAL FRAME DRIVE MEANS

As shown in FIG. 1, drive chain 98 is driven by gear box sprocket 100, and chain 98 in turn drives sprockets 94 and 96. An idler sprocket 272 compensates for discrete differences in chain link lengths between drive sprocket 100 and drive sprocket 94, which have fixed centers of rotation. Without idlwer gear 272, the portion of the chain drive between sprocket 100 and sprocket 94 would have a tendency to lock up or bind. Drive chain lock up between driven sprockets 94 and 96 is prevented by left Teflon bearing blocks 130 and 132. As shown in FIG. 8, right Teflon bearing blocks 134 and 136 are closely fitted about dispenser support shaft 124, whereas left Teflon bearing blocks 130 and 132 are provided with lost motion slots 274 and 276 which permit horizontal shifting of Teflon bearing blocks 132 and 132 relative to dispenser support shaft 122. This shifting of the bearing blocks 130 and 132 compensates for chain link variation by automatically adjusting the distance between the centers of driven sprockets 94 and 96. With this compensating chain and sprocket drive system the chain runs freely without any tendency to lock up or bind.

Referring to FIGS. 4 and 5, the dispensing heads 150 and 152 are timed to open and begin charging the product into receptacles 278 when the heads are at 3:00 o'clock moving down in clockwise direction. The filling of the receptacle is completed between 5:00 and 6:00 o'clock (see FIG. 5), except for the quick pulse of air which occurs immediately thereafter and lasts for but a fraction of a second, whereby inadvertent discharge of the product beyond the receptacle rim 280 is avoided. The conveyor drive is not a part of this invention but is shown in FIG. 1 for illustrative purposes only as comprising a drive motor 282, drive sprocket 284, driven chain 286, driven sprocket 288, conveyor rollers 290 and 292, and conveyor belt 294 carrying receptacles 278, all mounted on conveyor frame 296. The frame 296 is depicted with broken lines at 298 to indicate that the conveyor may be of any desired length.

TYPICAL SEQUENCE OF OPERATIONS

Figure 12:
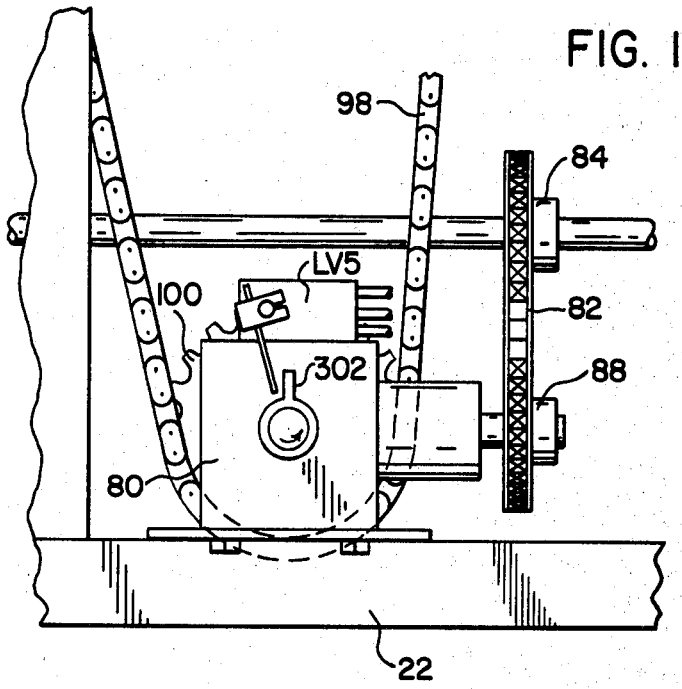
FIG. 12 is a fragmentary rear elevational view of the gear box and cam means.
Figure 13:
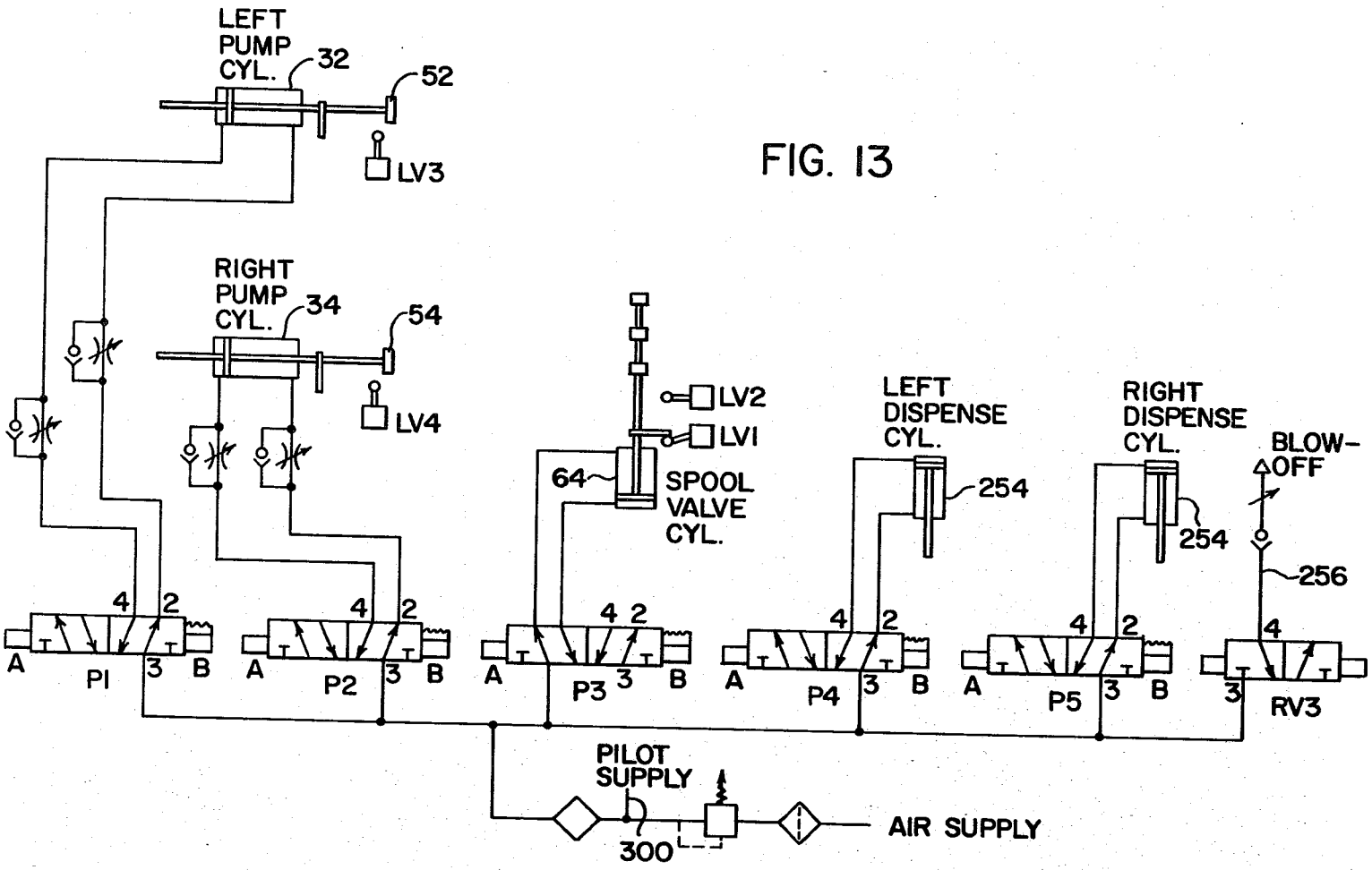
FIG. 13 is a schematic diagram of the pneumatic cylinder means used to operate a preferred embodiment of the invention; and FIGS. (14A and 14B) comprise a schematic diagram of the programming means for a preferred embodiment of the invention.

Reference is now made to FIGS. 12 and 13. Given a supply of pilot air 300, gear box drive cam 302, during each revolution, opens limit valve LV5 to energize right and left dispensing head pneumatic cylinders 150 and 152. Cylinders 150 and 152 raise plug valves 244 to their top positions shown in FIG. 6. Simultaneously, spool valve pneumatic cylinder 64 moves spool valve 62 from the position shown in FIG. 9 to the position shown in FIG. 10, whereby the vat ports 66 and 68 and dispenser ports 70 and 72 are closed.

As spool valve pneumatic cylinder 64 moves spool valve 62 into manifold block 24, limit valve LV1 is closed and limit valve LV2 is opened. The opening of limit valve LV2 actuates left and right plunger pneumatic cylinders 32 and 34 which move plungers 52 and 54 forward into plunger holes 56 and 58. As the cylinders 32 and 34 are moving plungers 52 and 54 forward, the cylinder air jet sensors 210 and 212 are released. With plungers 52 and 54 full forward, limit valves LV3 and LV4 are opened. Spool valve cylinder 64 then retracts spool valve 62, and limit valves LV1 and LV2 are reset. Dispenser plug valves 244 move down to orifice edges 262, closing ports 257. When plug valves 244 move down, manifold plungers 52 and 54 retract to their cycle starting positions, resetting limit valves LV3 and LV4. When plug valves 244 reach the bottom of their strokes at orifice edges 262, air line 256 admits air through air passages 246 to blow off food product residue from plunger lower surface 260. With the left and right plungers 52 and 54 in the full retracted position and dispenser ports 70 and 72 closed, the plungers 52 and 54 pull sufficient vacuum to draw another charge of food product from vat 74 into manifold chamber 60. With manifold chamber 60 recharged, the air jets 210 and 212 of left and right cylinders 32 and 34 signal cylinder 64 to start the next cycle.

TYPICAL PROGRAM MEANS

Referring now to FIGS. 14A and 14B, therein is schematically shown in detail the means to program the subject invention in accordance with the preceding sequence of operations.

The initial starting set up conditions are as follows:

1. Pilot air 300 is turned to "On."
2. Power air is turned to "On."
3. Selector valve SV1 is in "On" position.
4. Selector valve SV2 is in "Both" position.

After the initial manual set up, which can be performed by unskilled labor, the operation of the machine is thereafter fully automatic. The program of operation is broken down into the below numbered paragraphs for ease of reference.

1. Plunger cylinders 32 and 34 retract plungers 52 and 54.
2. Air jet sensors 210 and 212 are closed.
3. Spool valve 62 is retracted, limit valve LV1 is actuated.
4. Limit valve LV5 is actuated by revolution of drive cam 302 to open air to pilot line 304.
5. The "A" pilot port of relay valve RV4 receives an air signal and time delay valve TD5 begins to time out.
6. Relay valve RV4 is shifted from closed to open. When TD5 times out, the "B" pilot port of RV4 receives a pilot signal and RV4 returns to closed.
7. While RV4 is momentarily open, the "B" pilot ports of power valves P3, P4 and P5 receive signals and P3, P4 and P5 are shifted.
8. The spool valve 62 moves forward, releasing limit valve LV1 and actuating limit valve LV2. Dispenser cylinders 150 and 152 retract to the up position.
9. When the spool valve 62 is shifted inwardly to actuate LV2, the "A" pilot ports of power valves P1 and P2 receive pilot signals and P1 and P2 are shifted.
10. Plunger cylinders 32 and 34 move plungers 52 and 54 into manifold 24. Air jet sensors 210 and 212 actuate limit valves LV3 and LV4.
11. As LV3 and LV4 are actuated, the "A" pilot port of P3 receives a pilot signal and P3 is shifted, causing the spool valve 62 to retract. Time delay valve TD6 starts to time out. Once it has timed out, the "A" pilot ports of P4 and P5 receive pilot signals, shifting P4 and P5. This causes both dispenser cylinders 254 to move to the down position.
12. As the spool valve 62 retracts, LV2 is released, LV1 is actuated, and ports 66, 68, 70 and 72 are opened.
13. As LV1 is actuated, the "B" pilot ports of P1 and P2 receive pilot signals and P1 and P2 are shifted, causing the pump cylinders 32 and 34 to return to the back position. Time delay valve TD1 begins to time out.
14. As the pump cylinders 32 and 34 retract, they release LV3 and LV4 and close off both air jets.
15. As TD1 times out, the "A" pilot port of power valve P6 receives a pilot signal and P6 is shifted, beginning the opening of air line 256. Time delay valve TD4 begins to time out. When TD4 times out, the "B" pilot port of P6 receives a signal, shifting P6 back and closing air line 256.
16. When air line 256 is closed and both jet sensors 210 and 212 are closed by the pump cylinders 32 and 34, the cycle is then completed and ready to be repeated.
17. If either the left or right pump 32 or 34 is to be operated alone, the operator simply turns SV2 to the right or left position, as required.

SUMMATION

A reading of the foregoing description in conjunction with a study of the drawings will establish that the subject invention discloses a novel improvement in high speed metering and dispensing machines. The disclosed invention is fully automatic and is completely programmed and actuated by pneumatic valves, limit switches and timers which control every movement of the machine. The invention has eliminated any need for electrical or electronic controls. The total pump system is visible for inspection, and the pump distribution manifold is transparent for easy inspection and cleaning. The machine may be steam cleaned with either acid or caustic solutions under high pressure steam without removing any part completely. Furthermore, this is the only machine of its type known to the inventor which can be assembled, disassembled and set up for operation by unskilled lator. It is also the only machine of its type known to the inventor which can be shut down, rolled to another location and set up again in only a few minutes, also by unskilled labor.

The preferred embodiment of the invention shows two dispensing heads, but one or more than two can be advantageously utilized. It is also contemplated as an embodiment of this invention that the spool valve be split and driven by separate pneumatic cylinders and controls whereby the separate valve portions can operate independently of each other to provide separate and different timing and charging dispensing heads. Thus, receptacles of two different sizes may be simultaneously filled on the same conveyor line during the same run. The dispensors may also be placed in line to provide an in tandem dispensing operation, such as for buttering extra long loaves of bread.

Although the preferred embodiment of the machine has been shown and described in the context of food dispensing, it will be appreciated by those skilled in the art that this invention has many applications wherein liquids, semi-liquids, semi-solids and even some forms of solids can be accurately metered and dispensed with the same efficiency obtained in the food dispensing application. For instance, many types of medicaments, pharmaceutics, and numerous kinds of commercial plastics are amenable to processing by the subject invention. Thus, the invention is not intended to be solely limited to food processing uses, but rather is intended to be limited only by the scope of the subtended claims.

Having thus described the invention, it is claimed:

1. The improvement in a device to process measured amounts of a flowable product into open, non-pressurized receptacles comprising: a frame; a stationary unpressurized product reservoir, a distribution manifold, mechanical fluid pressure means, dispensing means, and program means all mounted on said frame; a valve chamber in said manifold; first port means interconnecting said reservoir and said valve chamber; second port means interconnecting said mechanical valve chamber and said fluid pressure means; third port means interconnecting said valve chamber to said dispensing means; valve means in said valve chamber programmed to open and to close said first and third port means in a predetermined, timed sequence; said mechanical fluid pressure means being programmed to apply negative pressure to said second port means in a predetermined, timed sequence, and to apply positive pressure to said second and third port means in a predetermined, timed sequence; and said dispensing means being programmed to open and to close in a predetermined timed sequence coordinated with the opening and closing of said valve chamber ports.

2. The device of claim 1, wherein said valve means and said pressure means are programmed to coact to urge a measured amount of said flowable product under pressure from said valve chamber to said dispensing means; and said dispensing means being programmed to timely open, receive and dispense said measured amount of flowable product and then close after said flowable product has been dispensed.

3. The device of claim 1, wherein said program means are adapted to sequentially actuate said valve means to open said first port means and to close said third port means; to actuate said pressure source to apply negative pressure to said first port means; to actuate said valve means to close said first port means and to open said third port means; to open said dispensing means; to dispense said flowable product; and to close said dispensing means.

4. The device of claim 1, wherein said program means is fluid pressure controlled.

5. The device of claim 1, wherein said program means is pneumatic pressure controlled.

6. The device of claim 1, including means to delay the closing of said dispensing means; and means to pneumatically clean said dispensing means after it has been closed.

7. The device of claim 1, for use with a conveyor and means to synchronize said program means with the movement of said conveyor.

8. The device of claim 7, including means to orbit said dispensing means; and means to synchronize the orbiting of said dispensing means with the movement of said conveyor.

9. The device of claim 1, wherein said reservoir comprises a vat having a pair of opposed flat portions joined at their edges by a pair of semi-conical portions, said flat portions being included from the vertical substantially 20° to converge downwardly, and with the lower edges of said vat enclosing said first port means.

10. The device of claim 1, wherein said manifold is a transparent acrylic resin.

11. The device of claim 1, wherein said manifold first and third port means are controlled by a spool valve.

12. The device of claim 11, wherein said valve chamber is cylindrical, said port means intersect said valve chamber; said intersections are rounded and the spools on said spool valve are fitted with O-rings in sealing contact with said chamber.

13. The device of claim 1, wherein said pressure source includes plunger means in said second port means driven by pneumatic cylinder means rearwardly shiftable from said manifold to disengage said plunger means from said manifold.

14. The device of claim 1, wherein said second port means comprises at least one port; a reciprocable plunger in said port; means to shift said plunger to create a negative pressure in said second port in timed relationship with the opening of said first port means to draw a product into said valve chamber and said one port; said shifting means being adapted to create a void in said one port at a greater rate than said void can be filled by said product; and said valve means being adapted to open said third port means before said product can be compressed against said plunger.

15. The device of claim 1, wherein said second port means comprises at least one port; a plunger in said port; a pneumatic cylinder having a piston therein connected to said plunger and adapted to reciprocate said plunger in said one port; a sensing rod secured to said piston on the end remote from said plunger; stop means positioned in the path of movement of said sensing rod; and means to arrest the movement of said piston responsive to coaction between said sensing rod and said stop means.

16. The device of claim 15, wherein said coaction comprises contact between said sensing rod and said stop means.

17. The device of claim 15, wherein said coaction comprises means to sense the distance between said sensing rod and said stop means and to arrest the movement of said piston upon the sensing of a predetermined distance.

18. The device of claim 17, wherein said sensing means are fluid pressure responsive.

19. The device of claim 17, wherein said sensing means are air pressure responsive.

20. The device of claim 15, wherein said stop means is adjustable toward and away from said sensing rod.

21. The device of claim 15, wherein said sensing rod includes a fluid pressure actuated sensing head.

22. The device of claim 15, wherein said sensing rod includes an air pressure actuated sensing head.

23. The device of claim 15, wherein said stop means comprises a threaded shaft carried in a threaded mounting block; and a hand wheel on the outboard end of said threaded shaft to thread said shaft inwardly and outwardly through said block.

24. The device of claim 1, wherein said first, second and third port means comprise pairs of ports; said valve means comprises a spool valve with first, second and third spools adapted to open said first pair of ports and to close said third pair of ports in a first position and to close said first pair of ports and to open said third pair of ports in a second position.

25. The device of claim 24, wherein each of said first, second and third spools is provided with a pair of spaced apart O-rings to seal said spools in said valve chamber during reciprocating movement.

26. The device of claim 25, wherein said first, second and third pairs of ports intersect said valve chamber, and said intersections being rounded to permit said O-rings to sweep over said intersections without interference from said intersections.

27. The device of claim 1, wherein said dispensing means comprises a cylindrical sleeve; intake port means in said sleeve to admit said flowable product; discharge port means in said sleeve; a cylindrical plug valve; programmed means to shift said plug valve in a first direction to open said intake port and in a second direction to close said port and to sweep all of said flowable product from the interior surface of said sleeve and out of said discharge port.

28. The device of claim 27, including means to air pulse said flowable product residue from the lower end of said plug valve.

29. The device of claim 27, wherein said sleeve is vertically aligned and has a closed upper end and an open lower end; said intake port is positioned in the lower side portion of said sleeve; said lower open end comprises said discharge port; means to admit air pressure between said plug valve and the closed upper end portion of said sleeve; and air vent holes passing vertically through said plug valve, whereby when said plug valve is shifted to the lower end of said sleeve, intake port and discharge ports are closed; and air may be pulsed under pressure through said plug valve air vent holes to blow off any product residue clinging to the lower surface of said plug valve.

30. The device of claim 29, wherein said plug valve in its lowermost shifted position extends beyond the lower edge of said sleeve.

31. The device of claim 29, wherein said plug valve in its uppermost position opens said intake and discharge ports.

32. The device of claim 27, including means to orbit said dispensing means while maintaining said cylinder sleeve in a vertical attitude, the rate of said orbiting being a function of the movement of a conveyor; said dispensing means being programmed to begin discharging said flowable product at substantially 90° of rotation from the top dead center of its orbital path and to complete said discharging substantially between 150° and 180° of rotation.

33. The device of claim 32, wherein said dispensing head is programmed to air pulse said plug valve following the discharge of said product.

34. The device of claim 32, wherein said means to orbit said dispensing means comprises a pair of horizontally spaced apart rotatable eccentrics; a cross bar secured at opposite ends to said eccentrics for orbital rotation therewith; means to secure said dispensing means to said cross bar; and menas to rotate said eccentrics.

35. The device of claim 34, wherein said means to rotate each said eccentric comprises a rotatably driven sprocket to which said eccentric is off-center mounted; a drive sprocket; and chain drive means interconnecting all three sprockets.

36. The device of claim 34, including an idler sprocket between said drive sprocket and one of said driven sprockets; said cross bar being positively secured at one end to the eccentric drivingly secured to said one of said driven sprockets and the other end of said cross bar being secured to the other of said eccentrics by lost motion means; whereby discrete differences in chain link lengths between said drive sprocket and said one of said driven sprockets is compensated by said idler gear; and discrete differences in chain link lengths between said one of said driven sprockets and the other of said driven sprockets and between the other of said driven sprockets and said drive sprocket are compensated by said cross bar lost motion means.

37. The device of claim 36, wherein said drive sprocket is driven by a gear box; and said gear box is driven by a conveyor power take off.

38. The device of claim 37, wherein said power take off comprises a conveyor drive sprocket, a gear box driven sprocket and drive chain interconnecting said sprockets.

39. The device of claim 1, wherein said dispensing means comprises at least one dispensing head; said first port means comprises at least one port; said second port means comprises at least one port; said third port means comprises at least one port; and said valve means comprises at least one valve.

40. The device of claim 39, including means to orbit said dispensing head; and means to actuate said dispensing head as a function of its angular position in its orbit.

41. The device of claim 1, wherein said dispensing means comprises two dispensing heads; said first port means comprises two ports; said second port means comprises two ports; said third port means comprises two ports; and said valve means comprises one valve.

42. The device of claim 41, including means to orbit said dispensing heads and means to actuate said dispensing heads as a function of their angular positions in their respective orbits.

43. The device of claim 1, wherein each of said first, second and third port means comprises first and second ports; said valve means comprises first and second valves; said dispensing means comprises first and second dispensing heads; said fluid pressure means comprises first fluid pressure means for said first ports and second pressure means for said second ports; first program means for said first valve, ports and dispensing head and second program means for said second valve ports and dispensing head, whereby said device is programmable to concurrently dispense two separate quantities of product from said reservoir.

44. The device of claim 1, in combination with a conveyor adapted to convey receptacle means beneath said dispensing means; cam means to actuate said program means; conveyor drive means; a power take off from said conveyor drive means; means to drivingly connect said power take off to said cam means.

45. The device of claim 1, including roller means to render said device movable from a first product dispensing station to a second product dispensing station.

46. The device of claim 1, including frame means upon which the recited elements of claim 1 are mounted; said frame comprising stainless steel seamless tubing, vertical and horizontal members welded together to provide an open sanitary rectangular structure; said vertical members comprising the legs of said frame; and castors secured to the bases of said legs.

47. The improvement in a device to process measured amounts of a flowable product into receptacles comprising: a transportable sanitary rectangular frame of welded seamless stainless steel tubing; pneumatic programming means; a chemical impervious plastic housing for said programming means; and a sanitary stainless steel product reservoir, all mounted on said frame; a sanitary acrylic plastic transparent distribution manifold having a cylindrical spool valve chamber; a first pair of ports interconnecting said reservoir and said valve chamber; a second pair of ports extending from said valve chamber to the exterior of said manifold; a pair of plungers in said second pair of ports; a pair of pneumatic cylinders adapted to reciprocate said plungers; a pair of slotted plates secured to said frame, said pair of cylinders being adapted to be releaseably secured to said pair of plates for shifting along said slots to permit insertion and withdrawal of said plungers from said manifold; a pair of product dispensing heads; a third pair of ports interconnecting said valve chamber and said pair of dispensing heads; a spool valve in said valve chamber programmed to sequentially open and close said first and third pairs of ports; said pair of pneumatic cylinders being programmed to reciprocate said pair of plungers in timed relationship with the opening and closing of said first and third pairs of ports to draw a measured amount of product from said reservoir into said valve chamber when said first pair of ports are open and said third pair of ports are closed, and to move said product from said valve chamber to said pair of dispensing heads when said first pair of ports are closed and said third pair of ports are open; said pair of dispensing heads being programmed to open when said third pair of ports are open and to close when said third pair of ports are closed; said pair of dispensing heads being mounted on a fixture; means to orbit said fixture; means to open said dispensing heads after approximately 90° of orbit from top dead center and to close said dispensing heads after approximately 150° to 180° of orbit from top dead center; means thereafter to air pulse said dispensing heads to remove product residue from said dispensing heads after said closing thereof; cam means to actuate said programming means; means to convey receptacles beneath said dispensing heads; and means to drive said cam means in synchronization with the conveyance of said receptacles.

48. The device of claim 47, including roller means to render said frame transportable.

49. The device of claim 47, wherein said reservoir comprises a vat having a pair of opposed flat portions joined at their edges by a pair of semi-conical portions, said flat portions being inclined from the vertical approximately 20° to converge downwardly toward said distribution manifold, and with the lower edges of said vat enclosing said first pair of ports in said distribution manifold.

50. The device of claim 47, including manual means to individually adjust the strokes of said pair of pneumatic cylinders, whereby said measured amounts of product may be varied.

51. The device of claim 47, wherein each of said dispensing heads comprises a cylindrical sleeve; an intake port in said sleeve to admit said product; a discharge port in said sleeve; a cylindrical plug valve programmed to shift in a first direction to open said intake port and in a second direction to close said intake port and to sweep all of said flowable product from the interior surface of said sleeve; and means to air pulse flowable product residue from the lower end of said plug valve.

52. The device of claim 47, including adjustable stop means; sensing rods extending from the ends of said pneumatic cylinders remote from said plungers; air sensors secured to the ends of said sensing rods and adapted to sense said stop means; and means to deactivate said cylinders when said air sensors are a predetermined distance from said adjustable stop means.

53. The device of claim 52, including manual means to adjust said stop means toward and away from said air sensors.

54. The device of claim 52, wherein said stop means comprise a pair of threaded shafts carried in a pair of threaded mounting blocks; and hand wheels on the outboard ends of said threaded shafts to thread said shafts inwardly and outwardly through said blocks.

* * * * *

UNITED STATES PATENT AND TRADEMARK OFFICE

CERTIFICATE OF CORRECTION

PATENT NO. : 4,398,577

DATED : August 16, 1983

INVENTOR(S) : Robert L. Sauer

It is certified that error appears in the above—identified patent and that said Letters Patent is hereby corrected as shown below:

Column 6, line 59 - delete "are"

Column 7, line 54 - change "pluses" to --pulses--.

Column 8, line 2 - change "idlwer" to --idler--.

line 11 - change "132" to --130--.

line 29 - change "driven" to --drive--.

Column 11, line 49 - change "included" to --inclined--.

Column 13, line 41 - change "menas" to --means--.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*